US009093059B2

(12) United States Patent
Dejima et al.

(10) Patent No.: US 9,093,059 B2
(45) Date of Patent: Jul. 28, 2015

(54) ELECTRONIC STRINGED INSTRUMENT, MUSICAL SOUND GENERATION METHOD, AND STORAGE MEDIUM

(71) Applicant: CASIO COMPUTER CO., LTD., Shibuya-ku, Tokyo (JP)

(72) Inventors: Tatsuya Dejima, Tokyo (JP); Tetsuichi Nakae, Tokyo (JP); Akio Iba, Tokyo (JP); Katsutoshi Sakai, Tokyo (JP); Kazuyoshi Watanabe, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/145,250

(22) Filed: Dec. 31, 2013

(65) Prior Publication Data

US 2014/0190338 A1 Jul. 10, 2014

(30) Foreign Application Priority Data

Jan. 8, 2013 (JP) ..... 2013-001419

(51) Int. Cl.

| | |
|---|---|
| ***G10H 1/46*** | (2006.01) |
| ***G10H 3/18*** | (2006.01) |
| ***G10H 3/12*** | (2006.01) |
| ***G10H 1/34*** | (2006.01) |

(52) U.S. Cl.

CPC ..... *G10H 1/46* (2013.01); *G10H 1/342* (2013.01); *G10H 3/12* (2013.01); *G10H 3/125* (2013.01); *G10H 3/18* (2013.01); *G10H 3/186* (2013.01); *G10H 2220/301* (2013.01); *G10H 2250/441* (2013.01); *G10H 2250/451* (2013.01)

(58) Field of Classification Search

USPC ..... 84/615, 616, 619, 653, 654, 657, 633
IPC ..... G10H 1/342,3/12, 3/18, 3/186, 1/46, G10H 2250/441, 2250/451
See application file for complete search history.

(56) References Cited

U.S. PATENT DOCUMENTS 4,038,897 A * 8/1977 Murray et al. ..... 84/722
4,321,852 A * 3/1982 Young, Jr. ..... 84/722

(Continued)

FOREIGN PATENT DOCUMENTS

EP 0 340 734 A2 11/1989
EP 0 749 107 A2 12/1996

(Continued)

OTHER PUBLICATIONS

Extended European Search Report (EESR) dated Mar. 27, 2014 (in English) issued in counterpart European Application No. 14150048.8.

*Primary Examiner* — David Warren
(74) *Attorney, Agent, or Firm* — Holtz, Holtz, Goodman & Chick PC

(57) ABSTRACT

An electronic stringed instrument 1 includes a string-pressing sensor 44 that detects a state of contact between each of a plurality of frets 23 and each of a plurality of strings 22. A CPU 41 detects that picking of any of the plurality of strings 22, provides a sound generation instruction to a connected sound source 45 to produce musical sound of a pitch determined based on the detected state of contact, detects a vibration pitch of the string 22 of which picking was detected, and corrects the pitch of the musical sound generated by the connected sound source 45 based on the detected vibration pitch.

15 Claims, 17 Drawing Sheets

(56) References Cited

U.S. PATENT DOCUMENTS

| | | | | | |
|---|---|---|---|---|---|
| 4,372,187 | A * | 2/1983 | Berg | 84/722 |
| 4,468,997 | A * | 9/1984 | Young, Jr. | 84/722 |
| 4,630,520 | A * | 12/1986 | Bonanno | 84/655 |
| 4,702,141 | A * | 10/1987 | Bonanno | 84/626 |
| 4,760,767 | A * | 8/1988 | Tsurubuchi | 84/646 |
| 4,953,439 | A * | 9/1990 | Newell | 84/655 |
| 5,018,428 | A | 5/1991 | Uchiyama et al. | |
| 5,024,134 | A | 6/1991 | Uchiyama | |
| 5,025,703 | A | 6/1991 | Iba et al. | |
| 5,121,669 | A | 6/1992 | Iba et al. | |
| 5,717,155 | A | 2/1998 | Szalay | |
| 6,191,350 | B1 * | 2/2001 | Okulov et al. | 84/646 |
| 8,093,482 | B1 * | 1/2012 | Kramer et al. | 84/485 R |
| 2004/0187673 | A1 * | 9/2004 | Stevenson | 84/737 |
| 2008/0236374 | A1 | 10/2008 | Kramer et al. | |
| 2010/0037755 | A1 * | 2/2010 | McMillen et al. | 84/645 |
| 2014/0190336 | A1 * | 7/2014 | Dejima | 84/622 |
| 2014/0190337 | A1 * | 7/2014 | Nakae et al. | 84/735 |
| 2014/0190338 | A1 * | 7/2014 | Dejima et al. | 84/735 |
| 2014/0202317 | A1 * | 7/2014 | Dejima | 84/646 |

FOREIGN PATENT DOCUMENTS

| | | | |
|---|---|---|---|
| JP | 63-136088 | A | 6/1988 |
| JP | 4296433 | B2 | 7/2009 |

* cited by examiner

ELECTRONIC STRINGED INSTRUMENT, MUSICAL SOUND GENERATION METHOD, AND STORAGE MEDIUM

This application is based upon and claims the benefit of priority from the prior Japanese Patent Application No. 2013-1419, filed on Jan. 8, 2013, the entire contents of which are incorporated herein by reference.

BACKGROUND OF THE INVENTION

1. Field of the Invention

The present invention relates to an electronic stringed instrument, a musical sound method, and a storage medium.

2. Related Art

An input control device has been conventionally known, which extracts a pitch of a waveform signal to be input, and instructs generation of musical sound corresponding to the extracted pitch. Regarding this type of device, for example, Japanese Unexamined Patent Application, Publication No. 563-136088 discloses a technique, in which a waveform-zero-cross cycle immediately after detecting the maximal value of an input waveform signal is detected, and a waveform-zero-cross cycle immediately after detecting the minimum value thereof is detected, and in a case in which the two cycles substantially coincide with each other, generation of musical sound of a pitch corresponding to the detected cycle is instructed; alternatively, the maximal value detection cycle of the input waveform signal is detected, and the minimum value detection cycle thereof is detected, and in a case in which the two cycles substantially coincide with each other, generation of musical sound of a pitch corresponding to the detected cycle is instructed.

Incidentally, Japanese Unexamined Patent Application, Publication No. S63-136088 also discloses an electronic guitar, to which the input control device disclosed therein is applied, in which a pick-up coil disposed to each string detects string vibration after picking a string as an input waveform signal. Time corresponding to at least 1.5 wavelengths is required to extract a pitch from an input waveform signal after picking a string. For example, when the fifth string of the guitar is picked in an open string state, picking sound at 110 Hz is generated, and 13.63 msec (corresponding to 1.5 wavelengths) is required to extract a pitch of this picking sound; therefore, by taking the processing time for error correction for noise or the like into account, the delay in extracting the pitch would amount to about 20 msec in total. The delay in pitch extraction is recognized as delay in sound generation, and in particular, the delay is felt more significant as the picking sound is pitched lower, resulting in a problem that the musical performance of the guitar gives an unnatural impression and/or uncomfortable feeling.

Furthermore, in order to resolve the delay in sound generation, Japanese Patent No. 4296433 discloses that a pitch is determined in advance based on pizzicato sound before picking a string, and sound generation processing is executed in a sound source after picking the string.

However, sufficient music expression has been impossible with this scheme, since the delay of at least one wavelength occurs in sound generation.

SUMMARY OF THE INVENTION

The present invention has been realized in consideration of this type of situation, and an object of the present invention is to provide an electronic stringed instrument capable of performing sufficient music expression by accelerating the speed from picking a string until generating sound.

In order to achieve the above-mentioned object, the electronic stringed instrument according to one aspect of the present invention includes:

a plurality of strings stretched above a fingerboard unit provided with a plurality of frets;

a state detection unit that detects a state between each of the plurality of frets and each of the plurality of strings;

a string picking detection unit that detects picking of any of the plurality of strings;

a sound generation instruction unit that provides a sound source with a sound generation instruction of musical sound of a pitch determined based on the state detected by the state detection unit;

a pitch detection unit that detects a vibration pitch of a string of which picking is detected by the string picking detection unit; and a correction unit that corrects the pitch of the musical sound generated by the sound source, based on the vibration pitch detected by the pitch detection unit.

DETAILED DESCRIPTION OF THE INVENTION

Descriptions of embodiments of the present invention are given below, using the drawings.

Overview of Electronic Stringed Instrument 1

Figure 1:
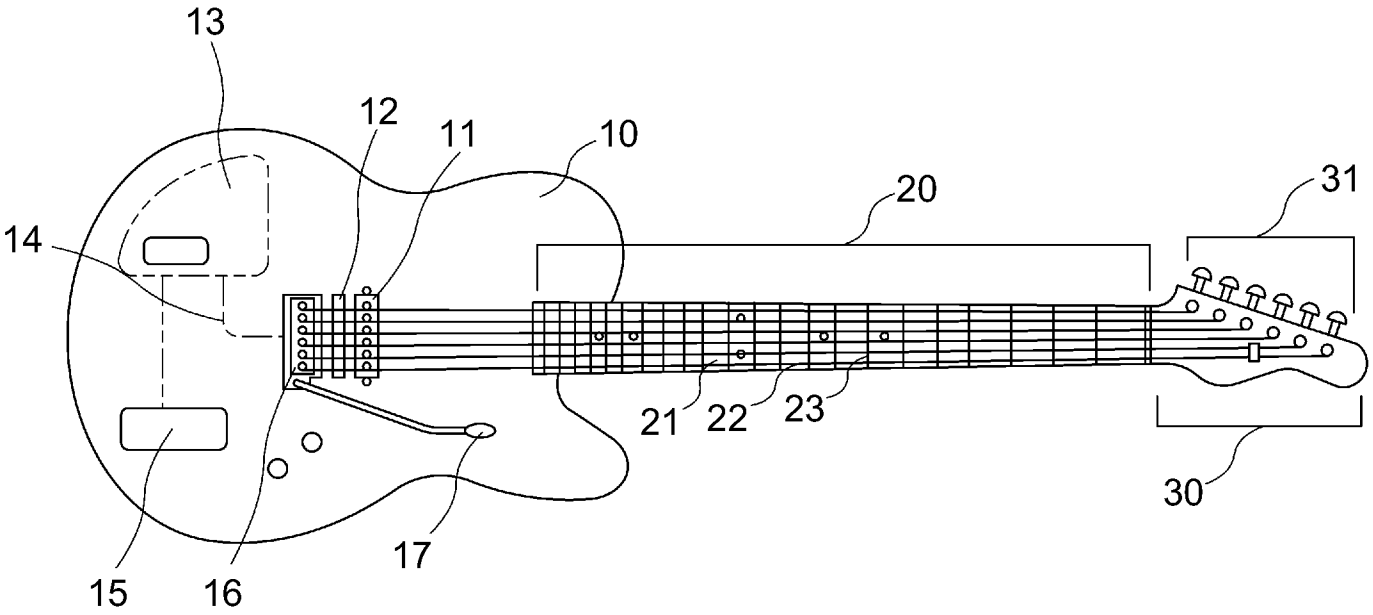
FIG. 1 is a front view showing an appearance of an electronic stringed instrument of the present invention.

First, a description for an overview of an electronic stringed instrument 1 as an embodiment of the present invention is given with reference to FIG. 1.

FIG. 1 is a front view showing an appearance of the electronic stringed instrument 1. As shown in FIG. 1, the electronic stringed instrument 1 is divided roughly into a body 10, a neck 20 and a head 30.

The head 30 has a threaded screw 31 mounted thereon for winding one end of a steel string 22, and the neck 20 has a fingerboard 21 with a plurality of frets 23 embedded therein. It is to be noted that in the present embodiment, provided are 6 pieces of the strings 22 and 22 pieces of the frets 23. 6 pieces of the strings 22 are associated with string numbers, respectively. The thinnest string 22 is numbered "1". The string number becomes higher in order that the string 22 becomes thicker. 22 pieces of the frets 23 are associated with fret numbers, respectively. The fret 23 closest to the head 30 is numbered "1" as the fret number. The fret number of the arranged fret 23 becomes higher as getting farther from the head 30 side.

The body 10 is provided with: a bridge 16 having the other end of the string 22 attached thereto; a normal pickup 11 that detects vibration of the string 22; a hex pickup 12 that independently detects vibration of each of the strings 22; a tremolo arm 17 for adding a tremolo effect to sound to be emitted; electronics 13 built into the body 10; a cable 14 that connects each of the strings 22 to the electronics 13; and a display unit 15 for displaying the type of timbre and the like.

Figure 2:
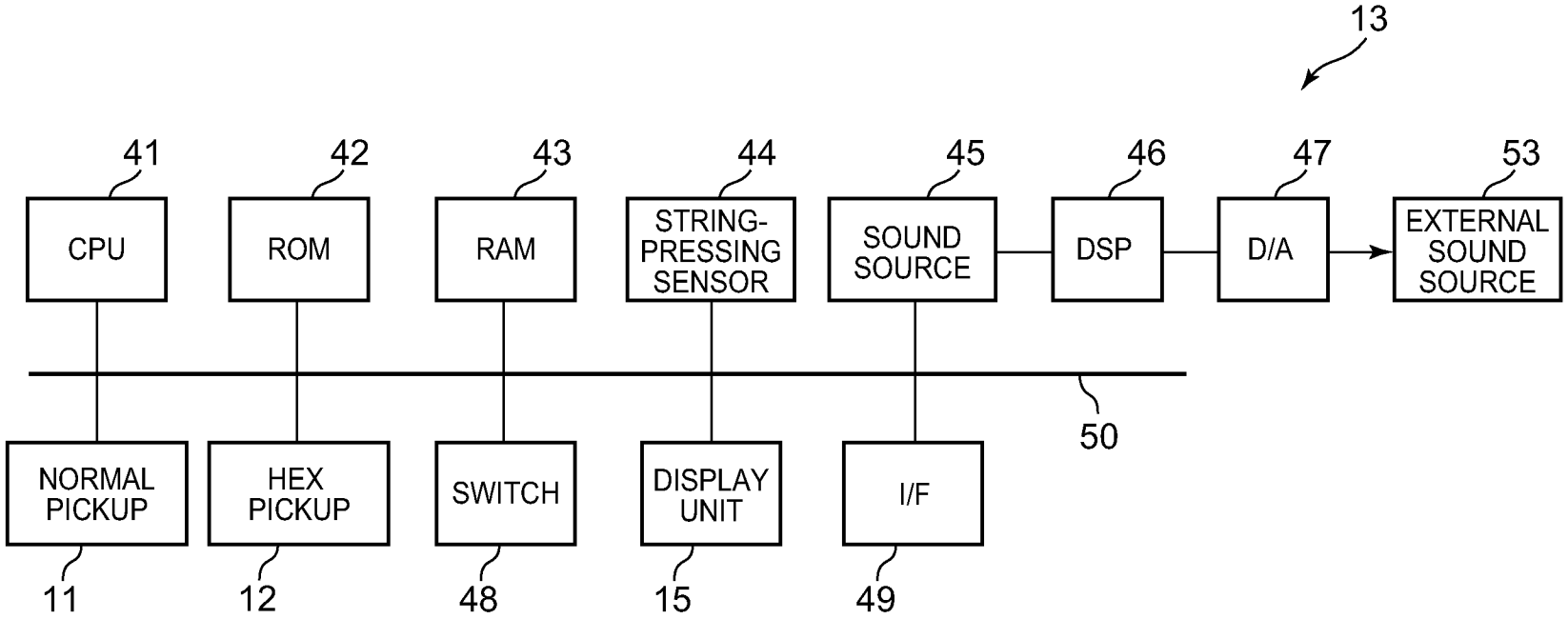
FIG. 2 is a block diagram showing an electronics hardware configuration constituting the above-described electronic stringed instrument.

FIG. 2 is a block diagram showing a hardware configuration of the electronics 13. The electronics 13 have a CPU (Central Processing Unit) 41, a ROM (Read Only Memory) 42, a RAM (Random Access Memory) 43, a string-pressing sensor 44, a sound source 45, the normal pickup 11, the hex pickup 12, a switch 48, the display unit 15, and an I/F (interface) 49, which are connected via a bus 50 to one another.

Additionally, the electronics 13 include a DSP (Digital Signal Processor) 46 and a D/A (digital/analog converter) 47.

The CPU 41 executes various processing according to a program recorded in the ROM 42 or a program loaded into the RAM 43 from a storage unit (not shown in the drawing).

In the RAM 43, data and the like required for executing various processing by the CPU 41 are appropriately stored.

The string-pressing sensor 44 detects which number of the fret is pressed by which number of the string. The string-pressing sensor 44 includes the type for detecting electrical contact of the string 22 (refer to FIG. 1) with the fret 23 (refer to FIG. 1) to detect a string-pressing position, and the type for detecting a string-pressing position based on output from an electrostatic sensor described below.

The sound source 45 generates waveform data of a musical sound instructed to be generated, for example, through MIDI (Musical Instrument Digital Interface) data, and outputs an audio signal obtained by D/A converting the waveform data to an external sound source 53 via the DSP 46 and the D/A 47, thereby giving an instruction to generate and mute the sound. It is to be noted that the external sound source 53 includes an amplifier circuit (not shown in the drawing) for amplifying the audio signal output from the D/A 47 for outputting, and a speaker (not shown in the drawing) for emitting a musical sound by the audio signal input from the amplifier circuit.

The normal pickup 11 converts the detected vibration of the string 22 (refer to FIG. 1) to an electric signal, and outputs the electric signal to the CPU 41.

The hex pickup 12 converts the detected independent vibration of each of the strings 22 (refer to FIG. 1) to an electric signal, and outputs the electric signal to the CPU 41.

The switch 48 outputs to the CPU 41 an input signal from various switches (not shown in the drawing) mounted on the body 10 (refer to FIG. 1).

The display unit 15 displays the type of timbre and the like to be generated.

Figure 3:
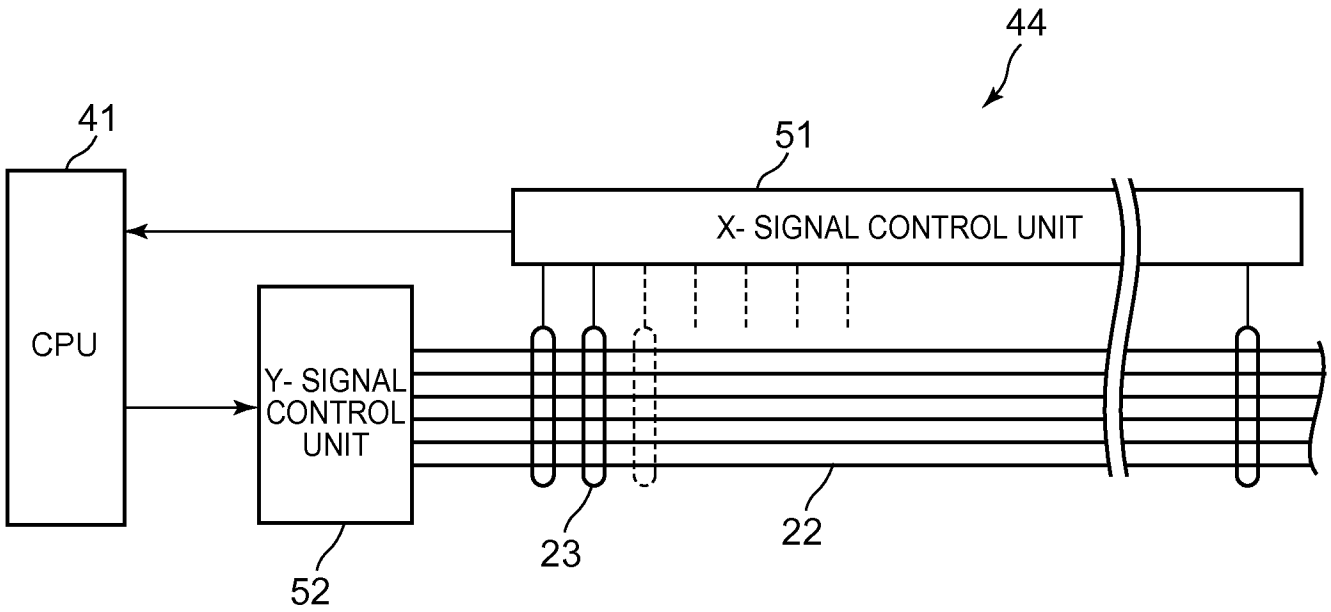
FIG. 3 is a schematic diagram showing a signal control unit of a string-pressing sensor.

FIG. 3 is a schematic diagram showing a signal control unit of the string-pressing sensor 44.

In the type of the string-pressing sensor 44 for detecting an electrical contact location of the string 22 with the fret 23 as a string-pressing position, a Y signal control unit 52 supplies a signal received from the CPU 41 to each of the strings 22. An X signal control unit 51 outputs, in response to reception of a signal supplied to each of the strings 22 in each of the frets 23 by time division, a fret number of the fret 23 in electrical contact with each of the strings 22 to the CPU 41 (refer to FIG. 2) together with the number of the string in contact therewith, as string-pressing position information.

In the type of the string-pressing sensor 44 for detecting a string-pressing position based on output from an electrostatic sensor, the Y signal control unit 52 sequentially specifies any of the strings 22 to specify an electrostatic sensor corresponding to the specified string. The X signal control unit 51 specifies any of the frets 23 to specify an electrostatic sensor corresponding to the specified fret. In this way, only the simultaneously specified electrostatic sensor of both the string 22 and the fret 23 is operated to output a change in an output value of the operated electrostatic sensor to the CPU 41 (refer to FIG. 2) as string-pressing position information.

Figure 4:
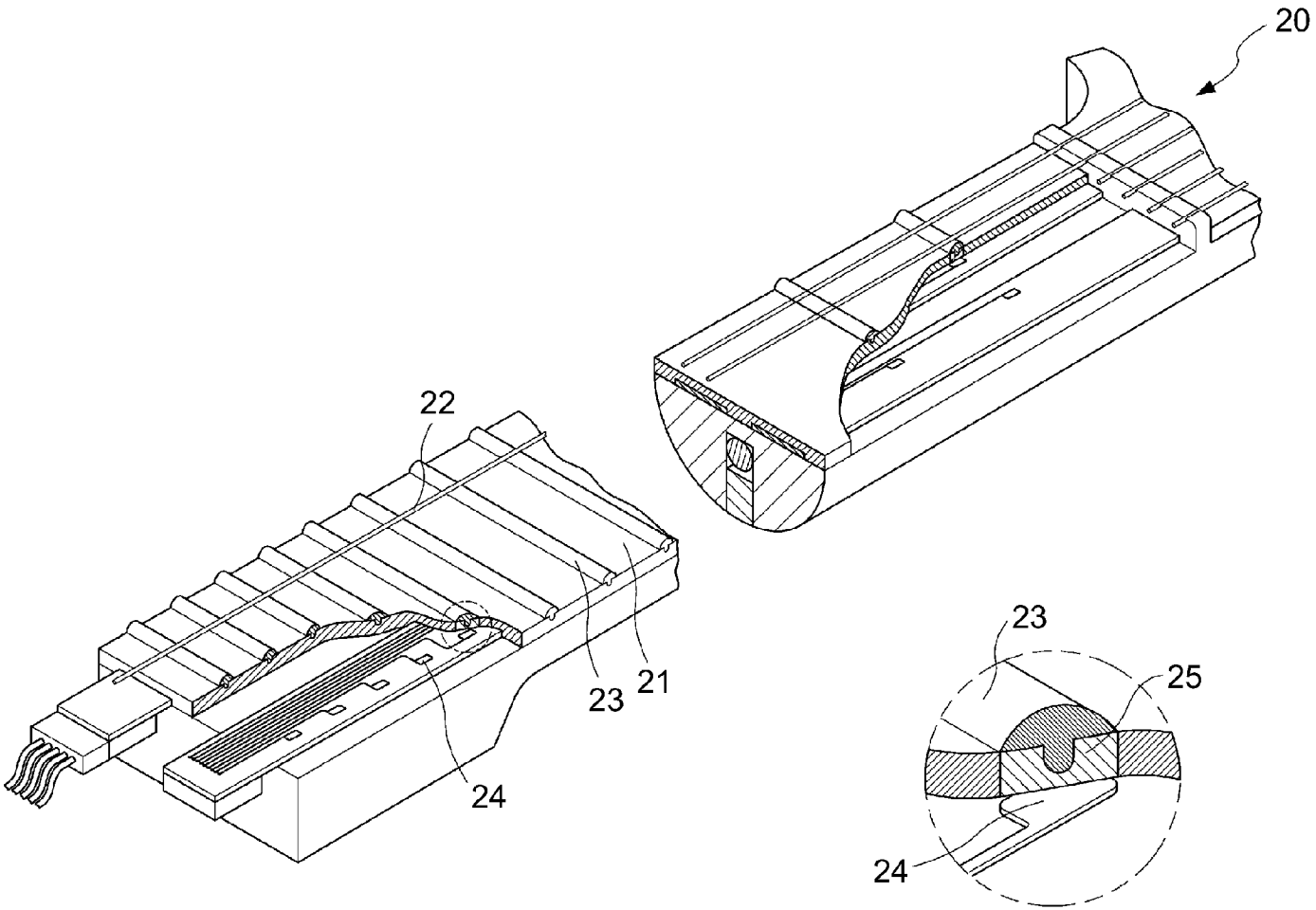
FIG. 4 is a perspective view of a neck applied with the type of string-pressing sensor for detecting electrical contact of a string with a fret.

FIG. 4 is a perspective view of the neck 20 applied with the type of string-pressing sensor 44 for detecting electrical contact of the string 22 with the fret 23.

In FIG. 4, an elastic electric conductor 25 is used to connect the fret 23 to a neck PCB (Poly Chlorinated Biphenyl) 24 arranged under the fingerboard 21. The fret 23 is electrically connected to the neck PCB 24 so as to detect conduction by contact of the string 22 with the fret 23, and a signal indicating which number of the string is in electrical contact with which number of the fret is sent to the CPU 41.

Figure 5:
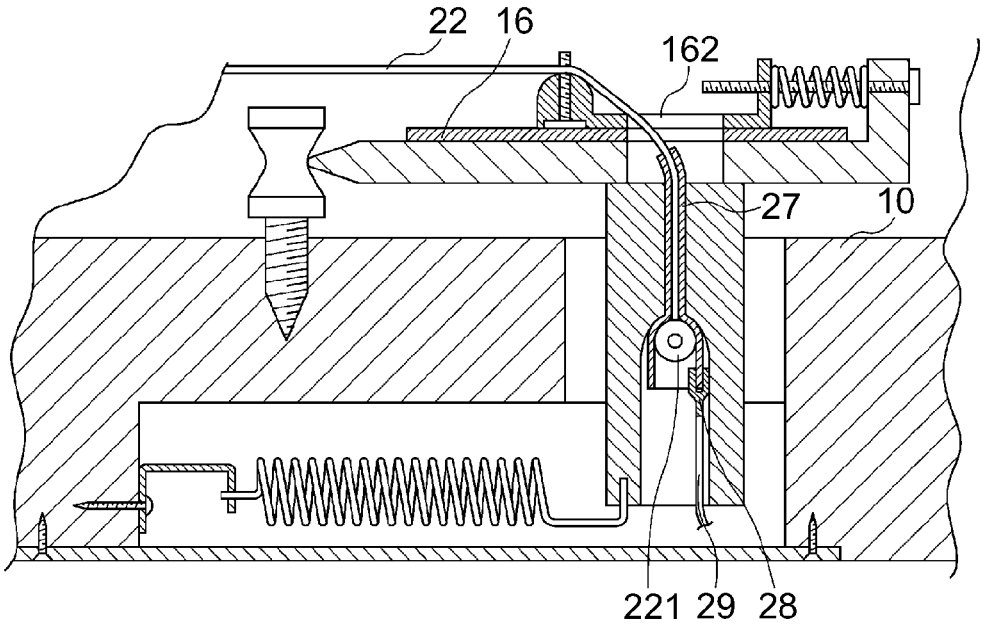
FIG. 5 is a longitudinal sectional view of a vicinity of a bridge.
Figure 6:
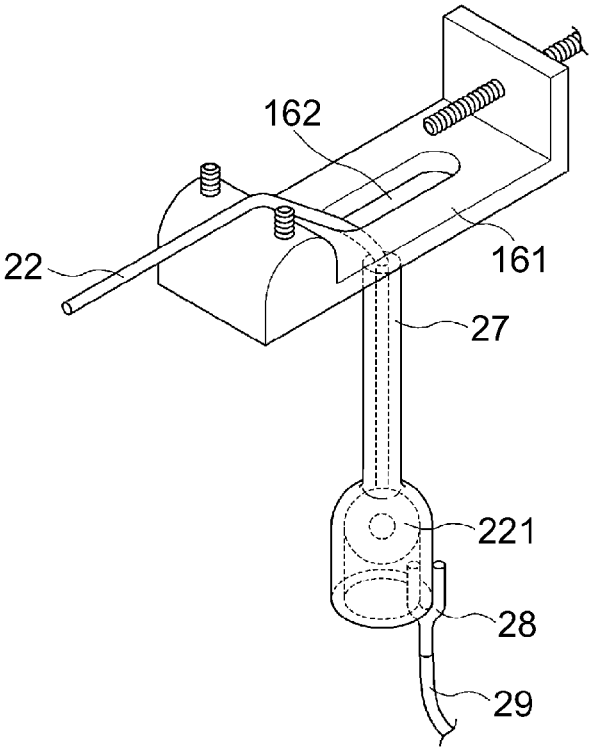
FIG. 6 is a perspective view of a bridge piece of the bridge.

FIG. 5 is a longitudinal sectional view of the vicinity of the bridge 16 of FIG. 1. FIG. 6 is a perspective view of a bridge piece 161 of the bridge 16 of FIG. 5. With reference to FIGS. 5 and 6, electrical independence of each string 22 is described.

Firstly, the bridge piece 161 of the bridge 16 is an insulator made of urea resin. The string 22 is passed through an opening 162 provided to the bridge 16, and is inserted into the main body 10. Furthermore, the string 22 is covered with a tube 27 as an insulator made of polyvinyl chloride, in a range from the opening 162 into the main body 10. The tube 27 has a conducting plane inside its inner surface, and the conducting plane is in contact with the string 22 and a ball end 221 of the string 22. Furthermore, one end of a wire 29 is connected to the tube 27 by way of caulking 28, and the other end of the wire 29 is connected to the electronic unit 13 (refer to FIG. 1).

Figure 7:
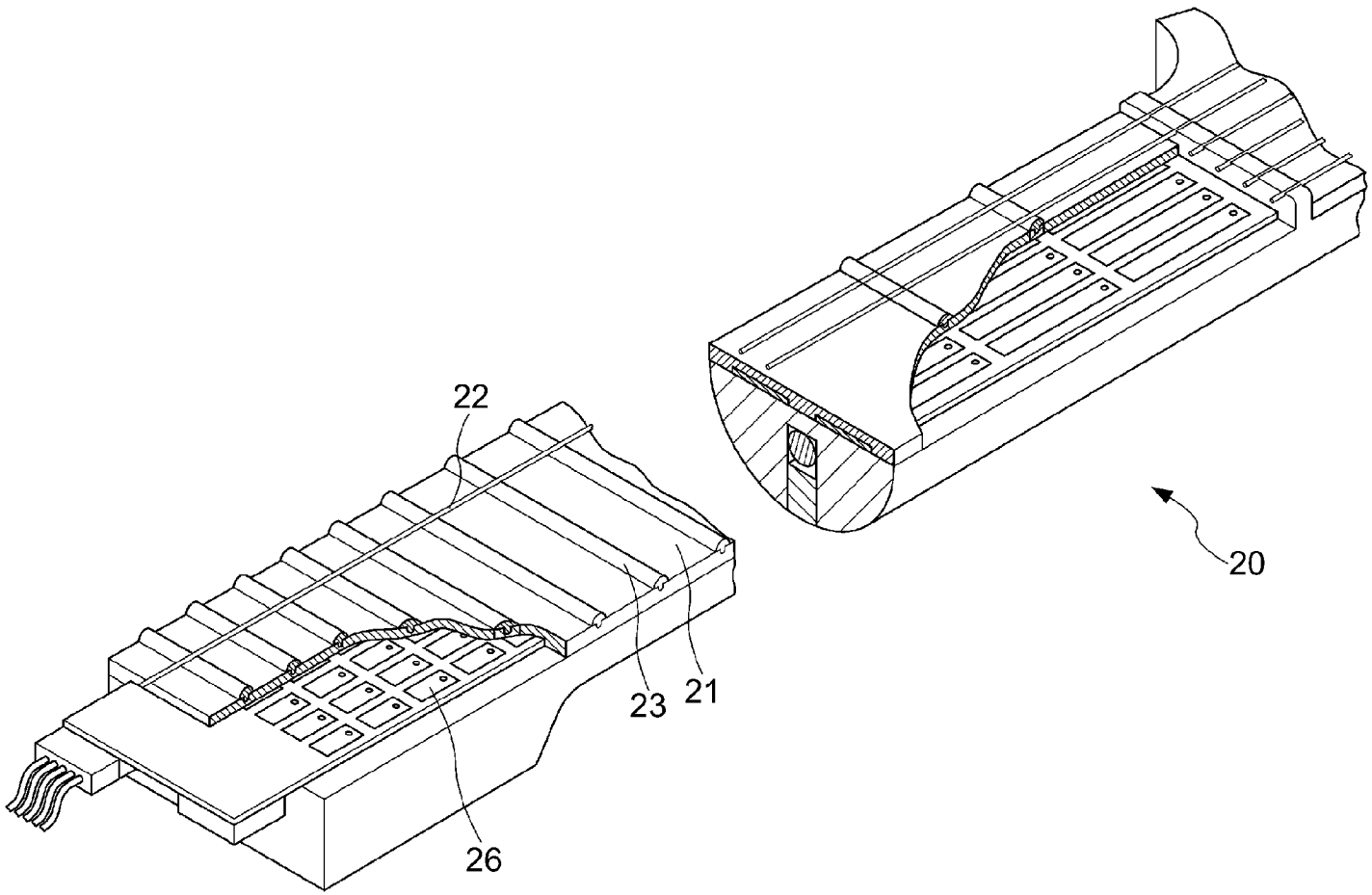
FIG. 7 is a perspective view of a neck applied with the type of a string-pressing sensor for detecting string-pressing without detecting contact of the string with the fret based on output from an electrostatic sensor.

FIG. 7 is a perspective view of the neck 20 applied with the type of the string-pressing sensor 44 for detecting string-pressing without detecting contact of the string 22 with the fret 23 based on output from an electrostatic sensor.

In FIG. 7, an electrostatic pad 26 as an electrostatic sensor is arranged under the fingerboard 21 in association with each of the strings 22 and each of the frets 23. That is, in the case of 6 strings×22 frets like the present embodiment, electrostatic pads are arranged in 144 locations. These electrostatic pads 26 detect electrostatic capacity when the string 22 approaches the fingerboard 21, and sends the electrostatic capacity to the CPU 41. The CPU 41 detects the string 22 and the fret 23 corresponding to a string-pressing position based on the sent value of the electrostatic capacity.

Main Flow

Figure 8:
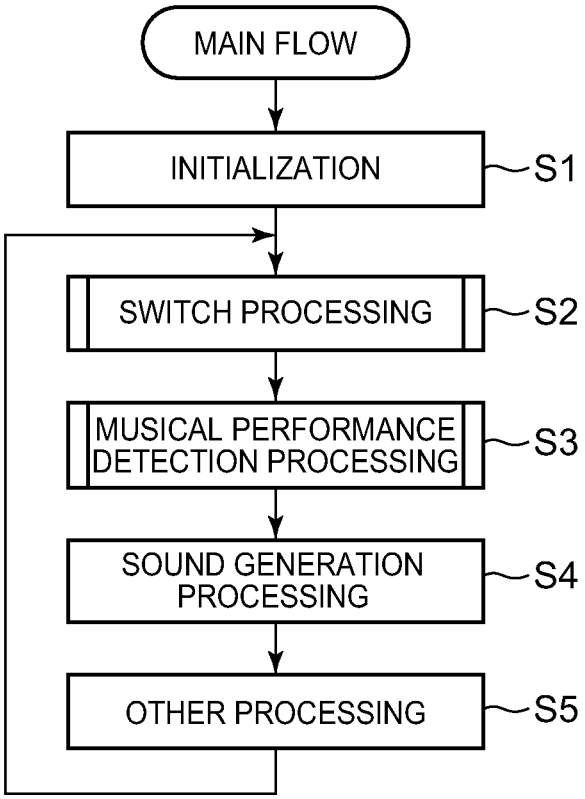
FIG. 8 is a flowchart showing a main flow executed in the electronic stringed instrument according to the present embodiment.

FIG. 8 is a flowchart showing a main flow executed in the electronic stringed instrument 1 according to the present embodiment.

Initially, in step S1, the CPU 41 is powered to be initialized. In step S2, the CPU 41 executes switch processing (described below in FIG. 9). In step S3, the CPU 41 executes musical performance detection processing (described below in FIG. 11). In step S4, the CPU 41 executes sound generation processing. In the sound generation processing, the CPU 41 causes the external sound source 53 to generate musical sound via the sound source 45 or the like. In step S5, the CPU 41 executes other processing. In the other processing, the CPU 41 executes, for example, processing for displaying a name of an output chord on the display unit 15. After the processing of step S5 is finished, the CPU 41 advances processing to step S2 to repeat the processing of steps S2 up to S5.

Switch Processing

Figure 9:
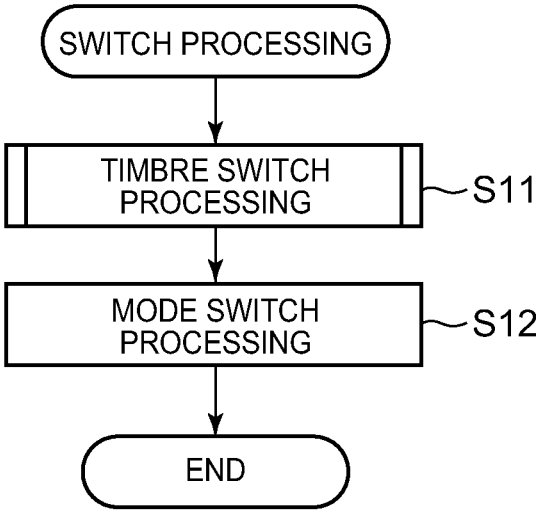
FIG. 9 is a flowchart showing switch processing executed in the electronic stringed instrument according to the present embodiment.

FIG. 9 is a flowchart showing switch processing executed in the electronic stringed instrument 1 according to the present embodiment.

Initially, in step S11, the CPU 41 executes timbre switch processing (described below in FIG. 10). In step S12, the CPU 41 executes mode switch processing. In the mode switch processing, the CPU 41 sets, in response to a signal from the switch 48, any mode of a mode of executing string-pressing position detection processing by detecting a state, which is, for example, electrical contact between the string and the fret (described below in FIG. 12) and a mode of executing string-pressing position detection processing by detecting contact between the string and the fret based on an output of the electrostatic sensor (described below in FIG. 13). After the processing of step S12 is finished, the CPU 41 finishes the switch processing.

Timbre Switch Processing

Figure 10:
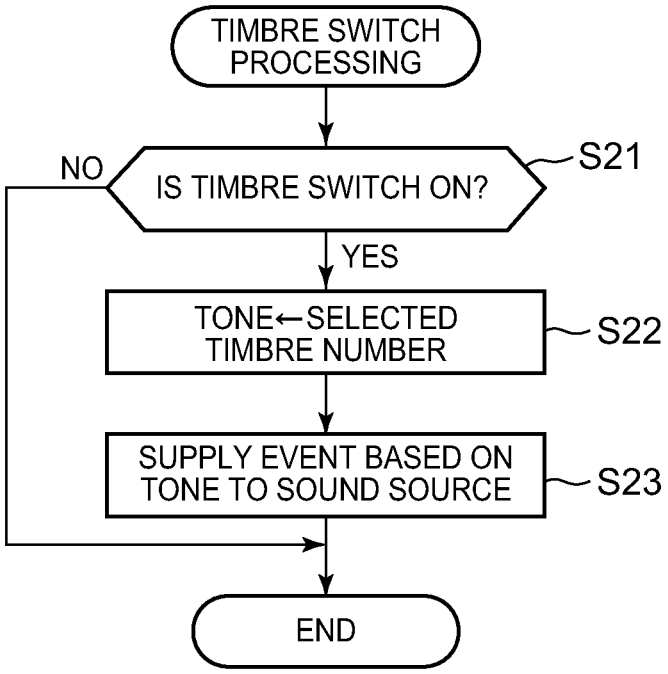
FIG. 10 is a flowchart showing timbre switch processing executed in the electronic stringed instrument according to the present embodiment.

FIG. 10 is a flowchart showing timbre switch processing executed in the electronic stringed instrument 1 according to the present embodiment.

Initially, in step S21, the CPU 41 determines whether or not a timbre switch (not shown in the drawing) is turned on. When it is determined that the timbre switch is turned on, the CPU 41 advances processing to step S22, and when it is determined that the switch is not turned on, the CPU 41 finishes the timbre switch processing. In step S22, the CPU 41 stores in a variable TONE a timbre number corresponding to timbre specified by the timbre switch. In step S23, the CPU 41 supplies an event based on the variable TONE to the sound source 45. Thereby, timbre to be generated is specified in the sound source 45. After the processing of step S23 is finished, the CPU 41 finishes the timbre switch processing.

Musical Performance Detection Processing

Figure 11:
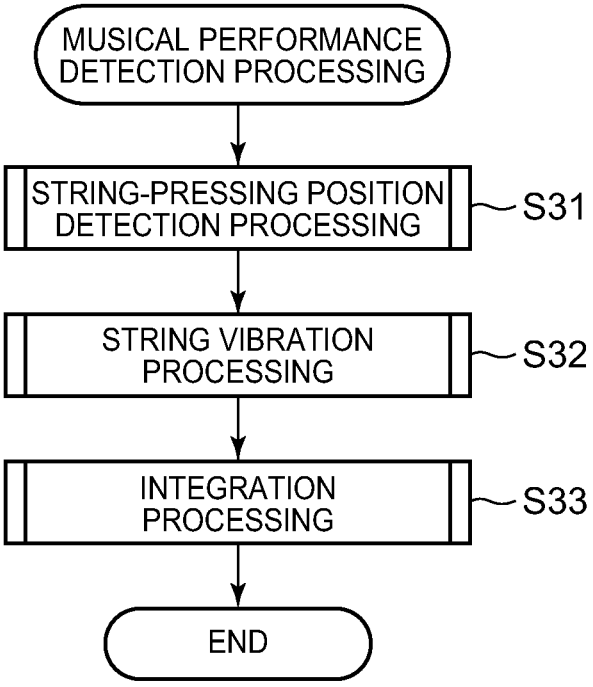
FIG. 11 is a flowchart showing musical performance detection processing executed in the electronic stringed instrument according to the present embodiment.

FIG. 11 is a flowchart showing musical performance detection processing executed in the electronic stringed instrument 1 according to the present embodiment.

Initially, in step S31, the CPU 41 executes string-pressing position detection processing (described below in FIGS. 12 and 13). At this time, in accordance with the mode which is set in the mode switch processing (refer to FIG. 9), the CPU 41 executes the string-pressing position detection processing by detecting electrical contact between the string and the fret (described below in FIG. 12), or executes the string-pressing position detection processing by detecting contact between the string and the fret based on an output of the electrostatic sensor (described below in FIG. 13). In step S32, the CPU 41 executes string vibration processing (described below in FIG. 14). In step S33, the CPU 41 executes integration processing (described below in FIG. 15). After the processing of step S33 is finished, the CPU 41 finishes the musical performance detection processing.

String-Pressing Position Detection Processing

Figure 12:
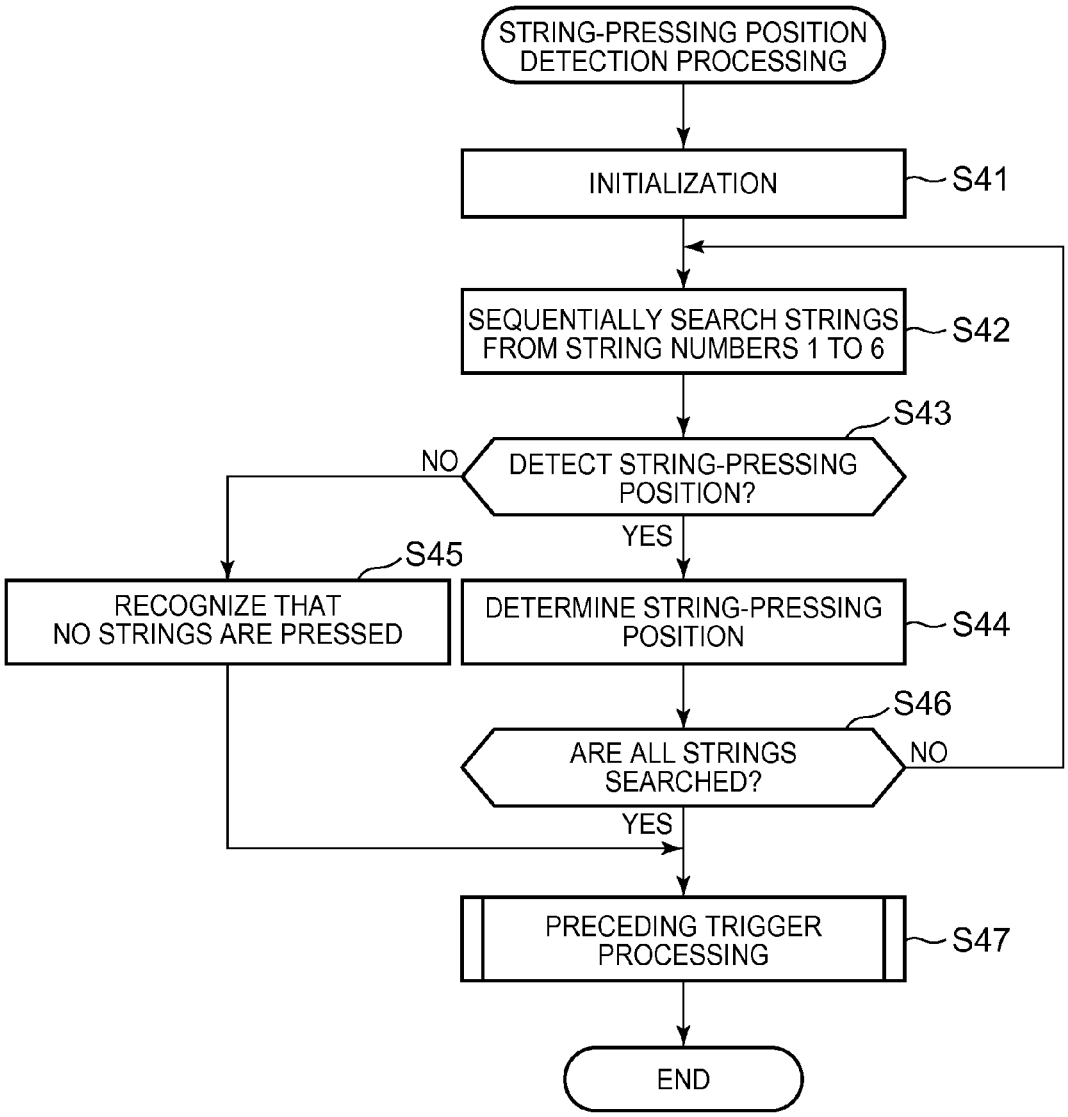
FIG. 12 is a flowchart showing string-pressing position detection processing executed in the electronic stringed instrument according to the present embodiment.

FIG. 12 is a flowchart showing string-pressing position detection processing (processing of step S31 in FIG. 11) executed in the electronic stringed instrument 1 according to the present embodiment. The string-pressing position detection processing is the processing for detecting electrical contact between the string and the fret.

Initially, in step S41, the CPU 41 executes initialization to initialize a register, etc. to be used in this flow. Subsequently, in step S42, the CPU 41 sequentially searches the strings for string-pressing positions (for example, the fret numbers of the frets in contact with the strings) from the string numbers 1 to 6. Here, when step S42 is executed for the first time, the string of the string number 1 is searched; and when step S42 is executed for the second time, the string of the string number 2 is searched. The respective strings are similarly searched until the loop processing is executed for six times.

In step S43, the CPU 41 determines whether or not any string-pressing position was detected in the strings searched in step S42. In a case where it is determined that any string-pressing position was detected, the CPU 41 advances the processing to step S44. In step S44, among one or more detected string-pressing positions, a position corresponding to the largest fret number is determined to be a string-pressing position. In other words, among one or more detected string-pressing positions, the fret being the closest to the bridge is determined to have been pressed.

On the other hand, in step S43, in a case where it is determined that any string-pressing position was not detected, the CPU 41 advances the processing to step S45. In step S45, the CPU 41 recognizes that no strings are pressed, i.e. recognizes an open string state.

After the processing of step S44 or S45, the CPU 41 advances the processing to step S46, and determines whether or not all the strings (all the six strings) were searched. In a case where it is determined that all the strings were searched, the CPU 41 advances the processing to step S47, executes preceding trigger processing (described below in FIG. 16), and finishes the string-pressing position detection processing. On the other hand, in a case where it is determined that all the strings were not searched, the CPU 41 returns the processing to step S42.

String-Pressing Position Detection Processing

Figure 13:
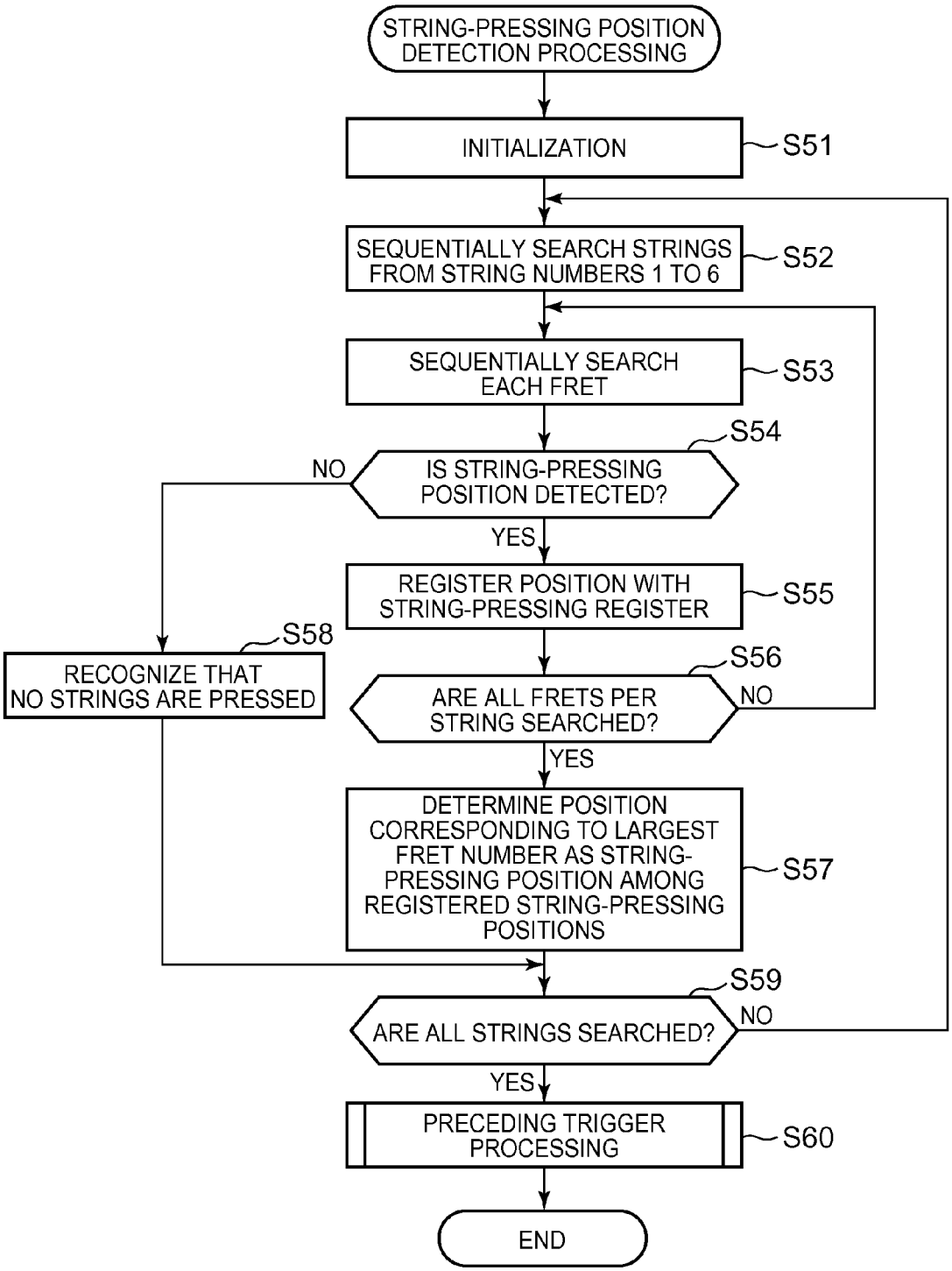
FIG. 13 is a flowchart showing the string-pressing position detection processing executed in the electronic stringed instrument according to the present embodiment.

FIG. 13 is a flowchart showing string-pressing position detection processing (processing of step S31 in FIG. 11) executed in the electronic stringed instrument 1 according to the present embodiment. The string-pressing position detection processing is the processing for detecting a string-pressing position based on an output of the electrostatic sensor.

Initially, in step S51, the CPU 41 executes initialization to initialize a register, etc. to be used in this flow. Subsequently, in step S52, the CPU 41 sequentially searches the electrostatic pads 26 in the ascending order of the string numbers from 1 to 6, in which the electrostatic pads 26 are provided correspondingly to the strings. Here, when step S52 is executed for the first time, the electrostatic pads 26 corresponding to the string of the string number 1 are searched; and when step S52 is executed for the second time, the electrostatic pads 26 corresponding to the string of the string number 2 are searched. The electrostatic pads 26 corresponding to the respective strings are similarly searched until the loop processing is executed for six times.

Subsequently, in step S53, the CPU 41 searches the electrostatic pads 26 corresponding to designated frets among the electrostatic pads 26 corresponding to the strings searched in step S52. In step S54, the CPU 41 determines whether or not the position corresponding to the electrostatic pad 26 searched in both of the string and the fret is a string-pressing position.

In the determination, in a case in which the electrostatic capacity detected in the corresponding electrostatic pad 26 (refer to FIG. 7) is a predetermined threshold value or more, the CPU 41 determines that a string is pressed. This determination utilizes a fact that, when a string is pressed, the pressed string approaches the electrostatic pad 26 in the pressed position, thereby significantly changing the electrostatic capacity detected in the electrostatic pad 26.

In a case where it is determined that a string-pressing position was detected in step S54, the CPU 41 registers the detected string-pressing position (for example, the pad number of the electrostatic pad 26) with a string-pressing register in step S55. Subsequently, in step S56, with regard to the electrostatic pads corresponding to the strings to be searched, the CPU 41 determines whether or not the electrostatic pads 26 corresponding to all the frets were searched. In a case where it is determined that all the corresponding electrostatic pads were searched, the CPU 41 advances the processing to step S57; and in a case where it is determined that all the corresponding electrostatic pads were not searched, the CPU 41 advances the processing to step S53. Therefore, the processing in steps S53 to S56 is repeated until determining that all the electrostatic pads corresponding to all the frets were searched.

In step S57, the CPU 41 selects any one of the string-pressing positions registered with the string-pressing register. In the present embodiment, a position of the electrostatic pad corresponding to the fret of the largest fret number is determined as a string-pressing position. In other words, among the string-pressing positions, the fret being the closest to the bridge is determined to have been pressed.

Here, naturally, a string-pressing position to be selected may correspond to the smallest fret number instead of the largest fret number.

In step S54, in a case where it is determined that a string-pressing position was not detected, the CPU 41 advances the processing to step S58. In step S58, the CPU 41 recognizes that no strings are pressed. In other words, the CPU 41 recognizes an open string state.

In step S59, the CPU 41 determines whether or not the electrostatic pads 26 corresponding to all the strings (all the six strings) were searched. In a case where it is determined that the electrostatic pads corresponding to all the strings were searched, the CPU 41 advances the processing to step S60; and in a case where it is determined that the electrostatic pads corresponding to all the strings were not searched, the CPU 41 advances the processing to step S51. In step S60, the CPU 41 executes preceding trigger processing (described below in FIG. 16). The preceding trigger processing may be executed between the processing in steps S57 and S58 and the processing in step S59. When the processing in step S60 is finished, the CPU 41 finishes the string-pressing position detection processing.

Preceding Trigger Processing

Figure 14:
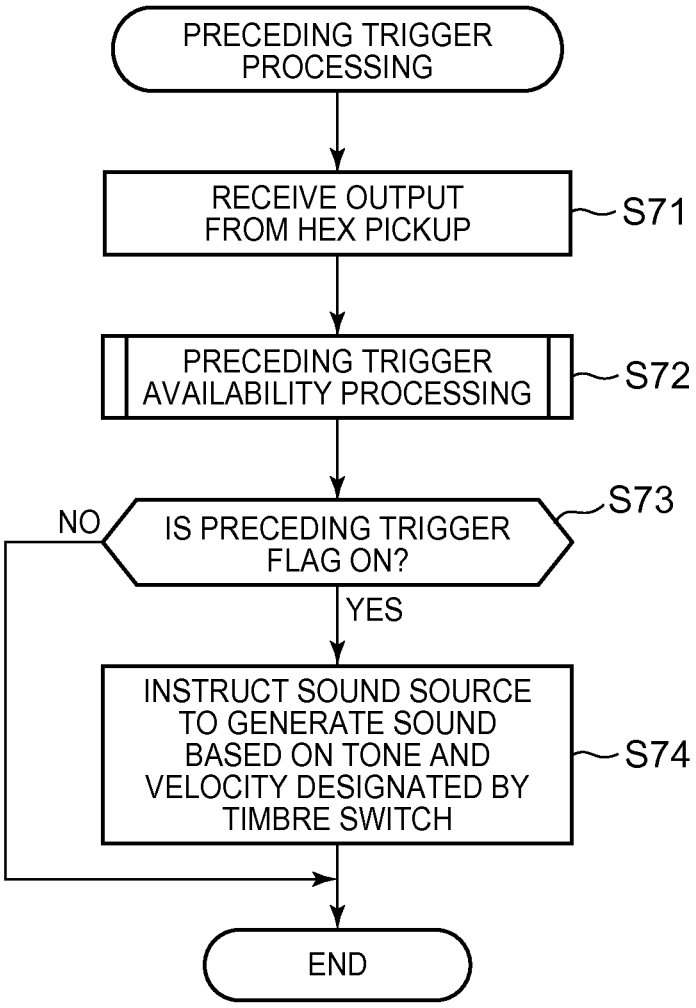
FIG. 14 is a flowchart showing preceding trigger processing executed in the electronic stringed instrument according to the present embodiment.

FIG. 14 is a flowchart showing preceding trigger processing (processing of step S45 in FIG. 12, and processing of step S60 in FIG. 13) executed in the electronic stringed instrument 1 according to the present embodiment. Here, the preceding trigger refers to a trigger for sound generation at the timing of detecting string-pressing before the player picks the string.

Initially, in step S71, the CPU 41 receives an output from the hex pickup 12 to obtain a vibration level of each string. In step S72, the CPU 41 executes preceding trigger availability processing (described below in FIG. 15). In step S73, the CPU 41 determines whether or not a preceding trigger is available, i.e. whether or not a preceding trigger flag is on. The preceding trigger flag is turned on in step S82 of the preceding trigger availability processing to be described later. In a case where the preceding trigger flag is on, the CPU 41 advances the processing to step S74; and in a case where the preceding trigger flag is off, the CPU 41 finishes the preceding trigger processing.

In step S74, the CPU 41 transmits a signal of instructing sound generation to the sound source 45, based on a tone designated by the timbre switch, and velocity determined in step S83 of the preceding trigger availability processing. When the processing in step S74 is finished, the CPU 41 finishes the preceding trigger processing.

Preceding Trigger Availability Processing

Figure 15:
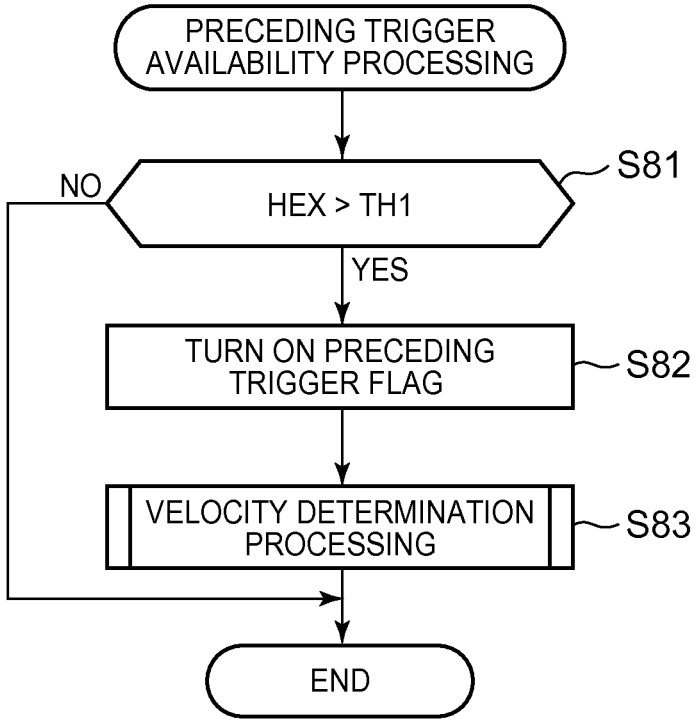
FIG. 15 is a flowchart showing preceding trigger availability processing executed in the electronic stringed instrument according to the present embodiment.

FIG. 15 is a flowchart showing the preceding trigger availability processing (processing of step S72 in FIG. 14) executed in the electronic stringed instrument 1 according to the present embodiment.

Initially, in step S81, the CPU 41 determines whether or not a vibration level of each string based on the output from the hex pickup 12 received in step S71 of FIG. 14 is larger than a predetermined threshold value (Th1). In a case where determination is YES, the CPU 41 advances the processing to step S82; and in a case where determination is NO, the CPU 41 finishes the preceding trigger availability processing.

In step S82, the CPU 41 turns on the preceding trigger flag to enable the preceding trigger. In step S83, the CPU 41 executes velocity determination processing (described below in FIG. 16). When the processing in step S83 is finished, the CPU 41 finishes the preceding trigger processing.

Velocity Determination Processing

Figure 16:
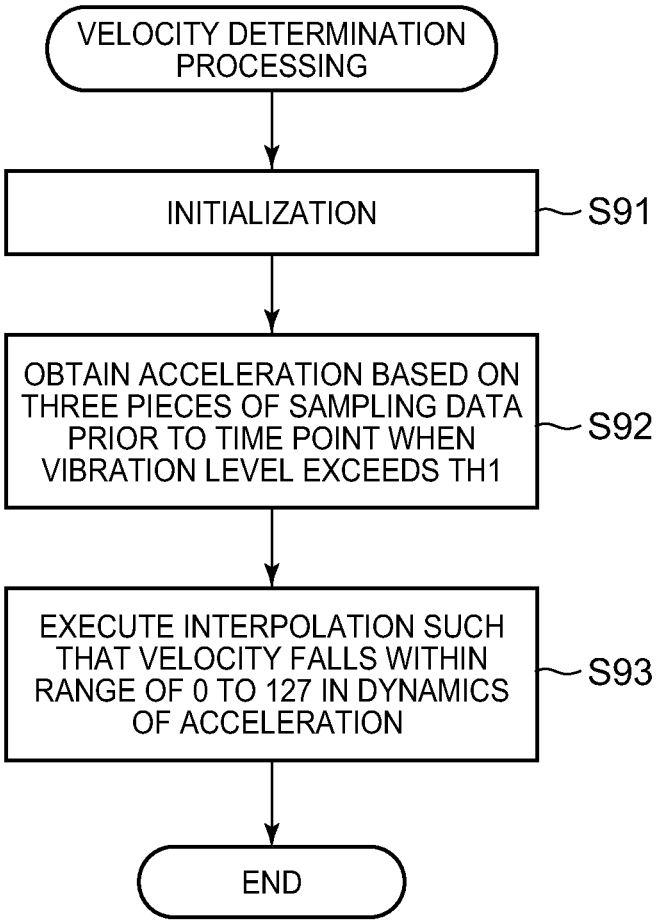
FIG. 16 is a flowchart showing velocity determination processing executed in the electronic stringed instrument according to the present embodiment.

FIG. 16 is a flowchart showing the velocity determination processing (processing of step S83 in FIG. 15) executed in the electronic stringed instrument 1 according to the present embodiment.

Initially, in step S91, the CPU 41 executes initialization. In step S92, the CPU 41 detects acceleration of change in the vibration level, based on sampling data of three vibration levels prior to a time point when the vibration level based on the output of the hex pickup exceeds Th1 (hereinafter referred to as "Th1 time point"). More specifically, a first speed of change in the vibration level is calculated based on the first and second pieces of sampling data prior to the Th1 time point. Furthermore, a second speed of change in the vibration level is calculated based on the second and third pieces of sampling data prior to the Th1 time point. Acceleration of change in the vibration level is detected based on the first speed and the second speed.

In step S93, the CPU 41 executes interpolation such that the velocity falls within a range of 0 to 127 in dynamics of experimentally-obtained acceleration.

More specifically, where the velocity is "VEL", the detected acceleration is "K", the dynamics of the experimentally-obtained acceleration is "D", and a correction value is "H", the velocity is calculated by the following equation (1).

$$VEL=(K/D)*128*H \quad (1)$$

Figure 22:
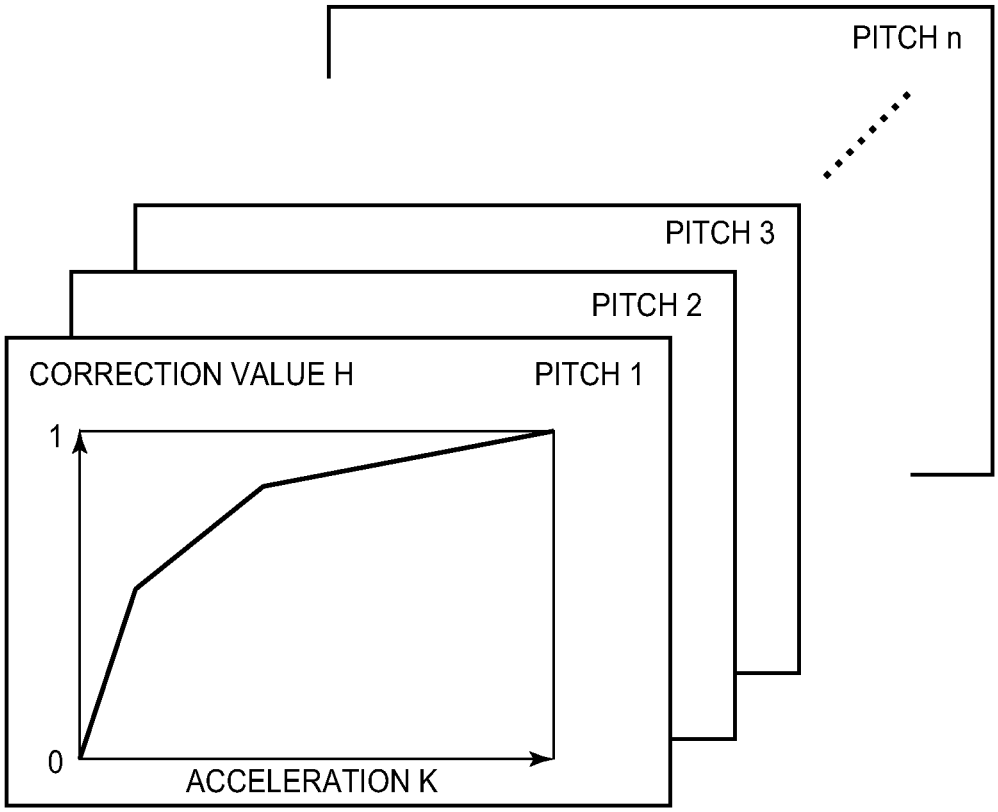
FIG. 22 is a map showing a relationship between acceleration and correction values.

FIG. 22 is a map showing a relationship between the acceleration K and the correction value H. The data of the map is stored in the ROM 42 for each pitch of each string.

With regard to a waveform of a certain pitch of a certain string, a peculiar characteristic is observed in change in the waveform immediately after separating a pick from a string. Therefore, by storing the data of the map of the characteristics into the ROM 42 for each pitch of each string in advance, the correction value H is obtained based on the acceleration K detected in step S92 of FIG. 16.

The acceleration of change in the vibration level is detected based on sampling data of three vibration levels prior to the Th1 time point in step S92; however, the detection is not limited thereto, and jerk of change in the vibration level may be detected based on sampling data of four vibration levels prior to the Th1 time point.

More specifically, the first speed of change in the vibration level is calculated based on the first and second pieces of sampling data prior to the Th1 time point. Furthermore, the second speed of change in the vibration level is calculated based on the second and third pieces of sampling data prior to the Th1 time point. Moreover, a third speed of change in the vibration level is calculated based on the third and fourth pieces of sampling data prior to the Th1 time point. First acceleration of change in the vibration level is detected based on the first speed and the second speed. Furthermore, second acceleration of change in the vibration level is detected based on the second speed and the third speed. Jerk of change in the vibration level is detected based on the first acceleration and the second acceleration.

In step S93, where the velocity is "VEL", the detected jerk is "KK", the dynamics of the experimentally-obtained jerk is "D", and the correction value is "H", the CPU 41 calculates the velocity by the following equation (2).

$$VEL=(KK/D)*128*H \quad (2)$$

The data of the map (not shown) illustrating the relationship between the jerk KK and the correction value H is stored in the ROM 42 for each pitch of each string.

The speed of change in the vibration level may be calculated based on the first and second pieces of sampling data prior to the Th1 time point; and the velocity may be calculated based on the speed.

String Vibration Processing

Figure 17:
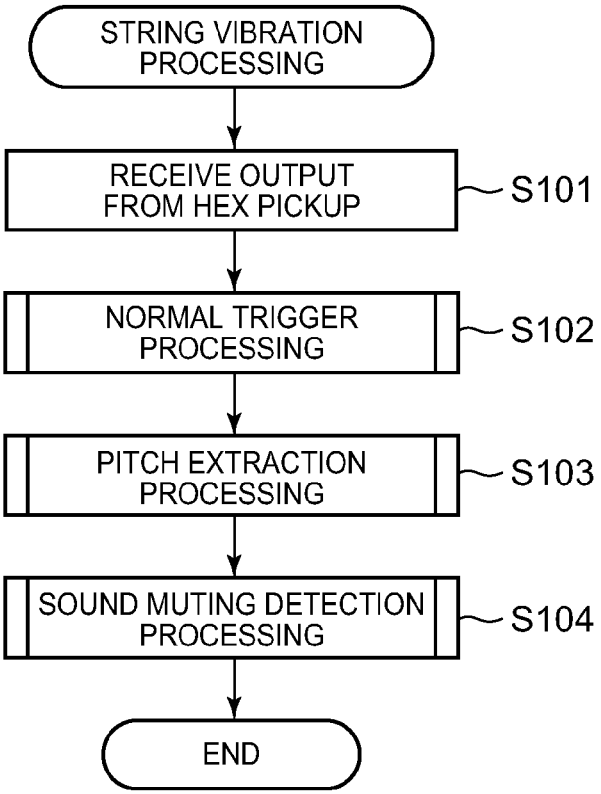
FIG. 17 is a flowchart showing string vibration processing executed in the electronic stringed instrument according to the present embodiment.

FIG. 17 is a flowchart showing string vibration processing (processing of step S32 in FIG. 11) executed in the electronic stringed instrument 1 according to the present embodiment.

Initially, in step S101, the CPU 41 receives an output from the hex pickup 12 to obtain a vibration level of each string. In step S102, the CPU 41 executes normal trigger processing (described below in FIG. 18). In step S103, the CPU 41 executes pitch extraction processing (described below in FIG. 19). In step S104, the CPU 41 executes sound muting detection processing (described below in FIG. 20). When the processing in step S104 is finished, the CPU 41 finishes the string vibration processing.

Normal Trigger Processing

Figure 18:
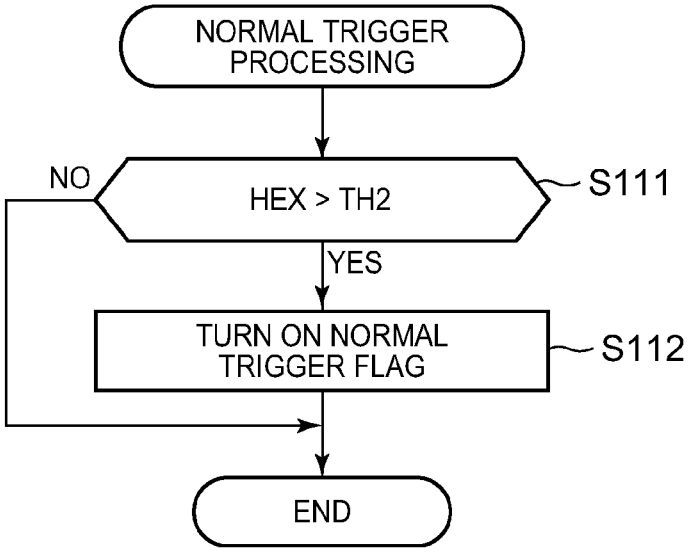
FIG. 18 is a flowchart showing normal trigger processing executed in the electronic stringed instrument according to the present embodiment.

FIG. 18 is a flowchart showing the normal trigger processing (processing of step S102 in FIG. 17) executed in the electronic stringed instrument 1 according to the present embodiment. The normal trigger refers to a trigger for sound generation at the timing of detecting that the player picks the string.

Initially, in step S111, the CPU 41 determines whether or not a vibration level of each string based on the output from the hex pickup 12 received in step S101 of FIG. 17 is larger than a predetermined threshold value (Th2). In a case where determination is YES, the CPU 41 advances the processing to step S112; and in a case where determination is NO, the CPU 41 finishes the normal trigger processing. In step S112, the CPU 41 turns on a normal trigger flag to enable the normal trigger. When the processing in step S112 is finished, the CPU 41 finishes the normal trigger processing.

Pitch Extraction Processing

Figure 19:
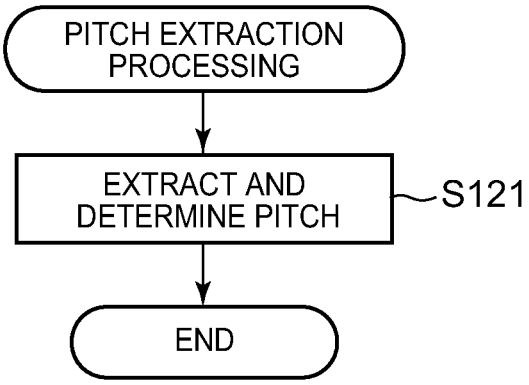
FIG. 19 is a flowchart showing pitch extraction processing executed in the electronic stringed instrument according to the present embodiment.

FIG. 19 is a flowchart showing pitch extraction processing (processing of step S103 in FIG. 17) executed in the electronic stringed instrument 1 according to the present embodiment.

In step S121, the CPU 41 extracts pitch by means of known art to decide pitch. Here, the known art includes, for example, a technique described in Japanese Unexamined Patent Application, Publication No. H1-177082.

Sound Muting Detection Processing

Figure 20:
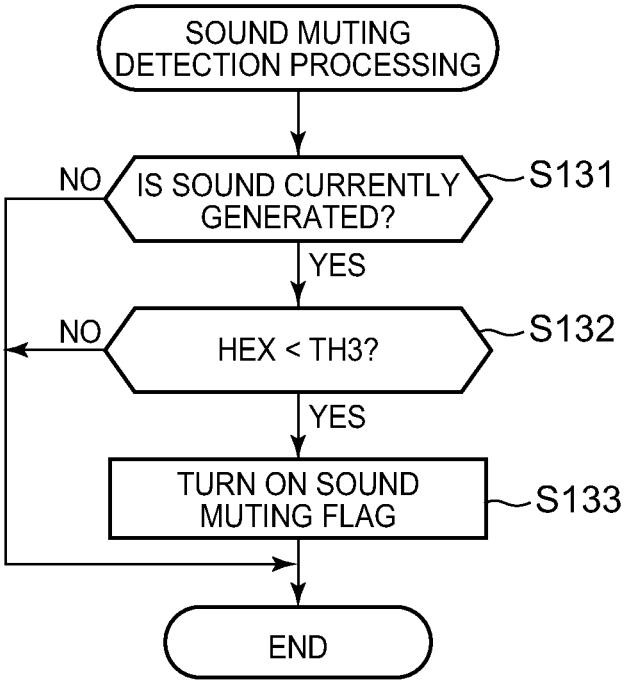
FIG. 20 is a flowchart showing sound muting detection processing executed in the electronic stringed instrument according to the present embodiment.

FIG. 20 is a flowchart showing sound muting detection processing (processing of step S104 in FIG. 17) executed in the electronic stringed instrument 1 according to the present embodiment.

Initially, in step S131, the CPU 41 determines whether or not sound is currently generated. In a case where determination is YES, the CPU 41 advances the processing to step S132; and in a case where determination is NO, the CPU 41 finishes the sound muting detection processing. In step S132, the CPU 41 determines whether or not a vibration level of each string based on the output from the hex pickup 12 received in step S101 of FIG. 17 is smaller than a predetermined threshold value (Th3). In a case where determination is YES, the CPU 41 advances the processing to step S133; and in a case where determination is NO, the CPU 41 finishes the sound muting detection processing. In step S133, the CPU 41 turns on a sound muting flag. When the processing in step S133 is finished, the CPU 41 finishes the sound muting detection processing.

Integration Processing

Figure 21:
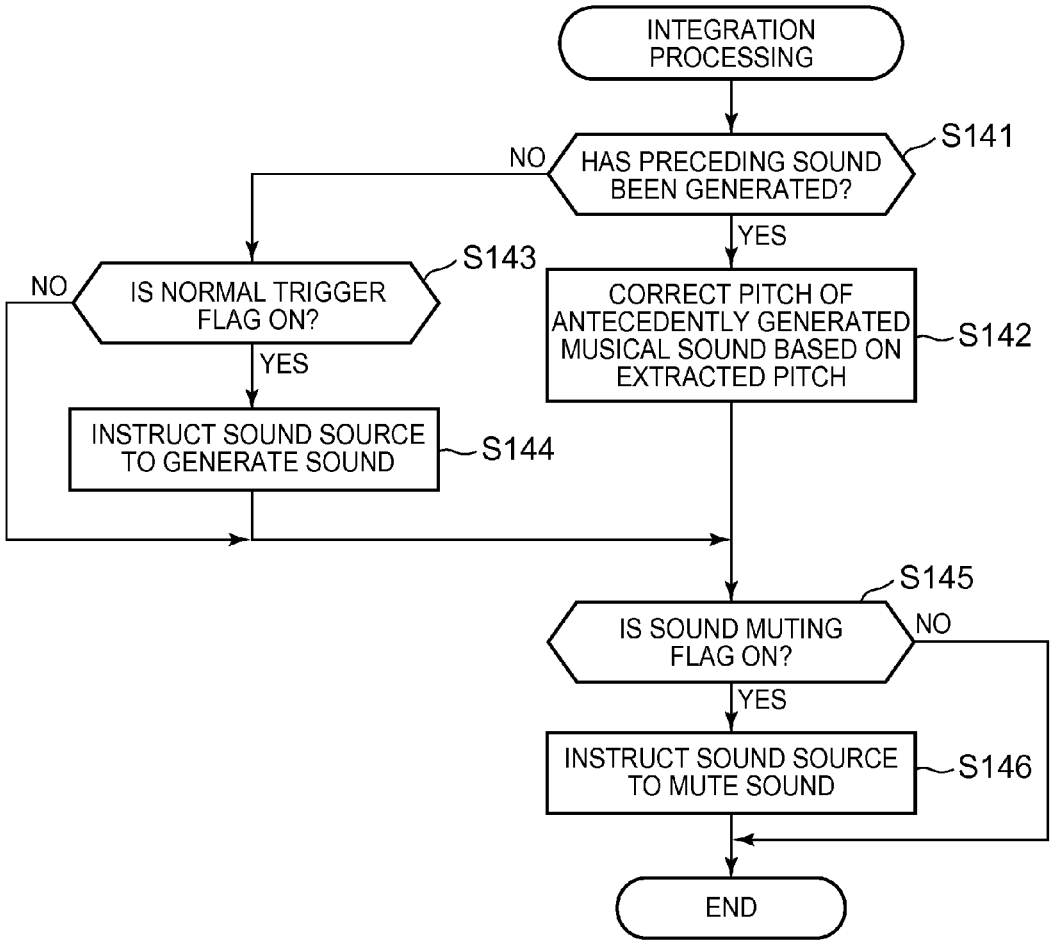
FIG. 21 is a flowchart showing integration processing executed in the electronic stringed instrument according to the present embodiment.

FIG. 21 is a flowchart showing integration processing (processing of step S33 in FIG. 11) executed in the electronic stringed instrument 1 according to the present embodiment. In the integration processing, a result of the string-pressing position detection processing (processing of step S31 in FIG. 11) is integrated with a result of the string vibration processing (processing of step S32 in FIG. 11).

Initially, in step S141, the CPU 41 determines whether or not preceding sound generation has been completed. In other words, in the preceding trigger processing (refer to FIG. 14), the CPU 41 determines whether or not a sound generation instruction was provided to the sound source 45. In a case where it is determined that a sound generation instruction was provided to the sound source 45 in the preceding trigger processing, the CPU 41 advances the processing to step S142. In step S142, the pitch data extracted in the pitch extraction processing (refer to FIG. 19) is transmitted to the sound source 45, thereby correcting the pitch of musical sound antecedently generated in the preceding trigger processing. Subsequently, the CPU 41 advances the processing to step S145.

On the other hand, in step S141, in a case where it is determined that a sound generation instruction was not provided to the sound source 45 in the preceding trigger processing, the CPU 41 advances the processing to step S143. In step S143, the CPU 41 determines whether or not the normal trigger flag is on. In a case where the normal trigger flag is on, in step S144, the CPU 41 transmits a sound generation instruction signal to the sound source 45, and advances the processing to step S145. In a case where the normal trigger flag is off, in step S143, the CPU 41 advances the processing to step S145.

In step S145, the CPU 41 determines whether or not the sound muting flag is on. In a case where the sound muting flag is on, in step S146, the CPU 41 transmits a sound muting instruction signal to the sound source 45. In a case where the sound muting flag is off, the CPU 41 finishes the integration processing. When the processing in step S146 is finished, the CPU 41 finishes the integration processing.

A description has been given above concerning the configuration and processing of the electronic stringed instrument 1 of the present embodiment.

In the present embodiment, the electronic stringed instrument 1 includes the string-pressing sensor 44 that detects a state of contact between each of the plurality of frets 23 and each of the plurality of strings 22, and the CPU 41 detects picking of any of the plurality of strings 22, provides a sound generation instruction to the connected sound source 45 to produce musical sound of the pitch determined based on the detected string-pressing position, detects a vibration pitch of the string 22 of which picking was detected, and corrects the pitch of the musical sound generated by the connected sound source 45 based on the detected vibration pitch.

Therefore, as compared with the electronic stringed instrument using conventional pitch extraction, the speed from the picking to the sound generation can be accelerated, and the pitch of the produced sound can be corrected to an appropriate pitch.

In the present embodiment, in the string-pressing sensor 44, the CPU 41 sequentially supplies a signal to each of the strings 22, and each of the frets 23 receives the signal supplied to each of the strings 22 in a time-sharing manner, thereby detecting contact between any of the strings 22 and the frets 23.

Therefore, the accuracy of detecting contact between the frets and the strings is improved.

In the present embodiment, the CPU 41 detects a degree of change in the vibration level of the string at the time point when detecting the state of contact, and determines volume of the musical sound of which generation was instructed, based on the detected degree of change.

Therefore, the volume of the musical sound of which generation was instructed can be determined without picking.

In the present embodiment, the CPU 41 detects a speed of change in the vibration level of the string as a degree of change.

Therefore, the volume can be determined without considering a maximum value of the waveform in terms of the vibration level of the string; and sound generation can be instructed to the sound source with appropriate volume intensity by presuming the volume immediately after the picking.

In the present embodiment, the CPU 41 detects acceleration of the change in the vibration level of the string as a degree of change.

Therefore, the volume can be determined without considering a maximum value of the waveform in terms of the vibration level of the string; and sound generation can be instructed to the sound source with appropriate volume intensity by presuming the volume immediately after the picking.

In the present embodiment, the CPU 41 detects jerk of the change in the vibration level of the string as a degree of change.

Therefore, the volume can be determined without considering a maximum value of the waveform in terms of the vibration level of the string; and sound generation can be instructed to the sound source with appropriate volume intensity by presuming the volume immediately after the picking.

A description has been given above concerning embodiments of the present invention, but these embodiments are merely examples and are not intended to limit the technical scope of the present invention. The present invention can have various other embodiments, and in addition various types of modification such as abbreviations or substitutions can be made within a range that does not depart from the scope of the invention. These embodiments or modifications are included in the range and scope of the invention described in the present specification and the like, and are included in the invention and an equivalent range thereof described in the scope of the claims.

What is claimed is:

1. An electronic stringed instrument, comprising:

a plurality of strings stretched above a fingerboard unit provided with a plurality of frets;

a state detector that detects a state between each of the plurality of frets and each of the plurality of strings;

a string picking detector that detects picking of any of the plurality of strings;

an acceleration-of-change detector that detects an acceleration of change in a string vibration level at a time point when the state detector detects the state;

a sound generation instruction unit that provides a sound source with a sound generation instruction of a musical sound of a pitch determined based on the state detected by the state detector and a volume based on the acceleration of change detected by the acceleration-of-change detector;

a pitch detector that detects a vibration pitch of a string of which picking is detected by the string picking detector; and a correction unit that corrects the pitch of the musical sound generated by the sound source, based on the vibration pitch detected by the pitch detector.

2. The electronic stringed instrument according to claim 1, wherein the state detector sequentially supplies a signal to each of the strings in a time-sharing manner, and detects whether or not the signal supplied to each of the strings is received by any of the frets, thereby detecting a fret and a string which are in contact with each other by a string-pressing operation.

3. The electronic stringed instrument according to claim 1, wherein the state detector includes electrostatic sensors in positions respectively corresponding to the plurality of frets correspondingly to the plurality of strings, and wherein detected electrostatic capacity of the electrostatic sensors changes as the strings approach thereto.

4. An electronic stringed instrument comprising:

a plurality of strings stretched above a fingerboard unit provided with a plurality of frets;

a state detector that detects a state between each of the plurality of frets and each of the plurality of strings;

a string picking detector that detects picking of any of the plurality of strings;

a speed-of-change detector that detects a speed of change in a string vibration level at a time point when the state detector detects the state;

a sound generation instruction unit that provides a sound source with a sound generation instruction of a musical sound of a pitch determined based on the state detected by the state detector and a volume based on the speed of change detected by the speed-of-change detector;

a pitch detector that detects a vibration pitch of a string of which picking is detected by the string picking detector; and a correction unit that corrects the pitch of the musical sound generated by the sound source, based on the vibration pitch detected by the pitch detector.

5. An electronic stringed instrument comprising:

a plurality of strings stretched above a fingerboard unit provided with a plurality of frets;

a state detector that detects a state between each of the plurality of frets and each of the plurality of strings;

a string picking detector that detects picking of any of the plurality of strings;

a jerk-of-change detector that detects a jerk of change in a string vibration level at a time point when the state detector detects the state;

a sound generation instruction unit that provides a sound source with a sound generation instruction of a musical sound of a pitch determined based on the state detected by the state detector and a volume based on the jerk of change detected by the jerk-of-change detector;

a pitch detector that detects a vibration pitch of a string of which picking is detected by the string picking detector; and a correction unit that corrects the pitch of the musical sound generated by the sound source, based on the vibration pitch detected by the pitch detector.

6. A musical sound generation method used in an electronic stringed instrument, the electronic stringed instrument including a plurality of strings stretched above a fingerboard unit provided with a plurality of frets, and a state detector that detects a state between each of the plurality of frets and each of the plurality of strings, the method comprising:

detecting picking of any of the plurality of strings;

detecting an acceleration of change in a string vibration level at a time point when the state detector detects the state;

providing a sound source with a sound generation instruction of a musical sound of a pitch determined based on the state detected by the state detector and a volume determined based on the detected acceleration of change;

detecting a vibration pitch of a string of which picking is detected; and correcting the pitch of the musical sound generated by the sound source, based on the detected vibration pitch.

7. The musical sound generation method according to claim 6, wherein the state detector sequentially supplies a signal to each of the strings in a time-sharing manner, and detects whether or not the signal supplied to each of the strings is received by any of the frets, thereby detecting a fret and a string which are in contact with each other as a result of the string being pressed.

8. The musical sound generation method according to claim 6, wherein the state detector includes electrostatic sensors in positions respectively corresponding to the plurality of frets correspondingly to the plurality of strings, and wherein detected electrostatic capacity of the electrostatic sensors changes as the strings approach thereto.

9. A musical sound generation method used in an electronic stringed instrument, the electronic stringed instrument including a plurality of strings stretched above a fingerboard unit provided with a plurality of frets, and a state detector that detects a state between each of the plurality of frets and each of the plurality of strings, the method comprising:

detecting picking of any of the plurality of strings;

detecting a speed of change in a string vibration level at a time point when the state detector detects the state;

providing a sound source with a sound generation instruction of a musical sound of a pitch determined based on the state detected by the state detector and a volume determined based on the detected speed of change;

detecting a vibration pitch of a string of which picking is detected; and correcting the pitch of the musical sound generated by the sound source, based on the detected vibration pitch.

10. A musical sound generation method used in an electronic stringed instrument, the electronic stringed instrument including a plurality of strings stretched above a fingerboard unit provided with a plurality of frets, and a state detector that detects a state between each of the plurality of frets and each of the plurality of strings, the method comprising:

detecting picking of any of the plurality of strings;

detecting a jerk of change in a string vibration level at a time point when the state detector detects the state;

providing a sound source with a sound generation instruction of a musical sound of a pitch determined based on the state detected by the state detector and a volume determined based on the detected jerk of change;

detecting a vibration pitch of a string of which picking is detected; and correcting the pitch of the musical sound generated by the sound source, based on the detected vibration pitch.

11. A non-transitory storage medium storing a program executable by a computer used in an electronic stringed instrument, the electronic stringed instrument including a plurality of strings stretched above a fingerboard unit provided with a plurality of frets, and a state detector that detects a state between each of the plurality of frets and each of the plurality of strings, the program being executable by the computer to execute functions comprising:

detecting picking of any of the plurality of strings;

detecting an acceleration of change in a string vibration level at a time point when the state detector detects the state;

providing a sound source with a sound generation instruction of a musical sound of a pitch determined based on the state detected by the state detector and a volume determined based on the detected acceleration of change;

detecting a vibration pitch of the string of which picking is detected; and correcting the pitch of the musical sound generated by the sound source, based on the detected vibration pitch.

12. The non-transitory storage medium according to claim 11, wherein the state detector sequentially supplies a signal to each of the strings in a time-sharing manner, and detects whether or not the signal supplied to each of the strings is received by any of the frets, thereby detecting a fret and a string which are in contact with each other by a string-pressing operation.

13. The non-transitory storage medium according to claim 11, wherein the state detector includes electrostatic sensors in positions respectively corresponding to the plurality of frets correspondingly to the plurality of strings, and wherein detected electrostatic capacity of the electrostatic sensors changes as the strings approach thereto.

14. A non-transitory storage medium storing a program executable by a computer used in an electronic stringed instrument, the electronic stringed instrument including a plurality of strings stretched above a fingerboard unit provided with a plurality of frets, and a state detector that detects a state between each of the plurality of frets and each of the plurality of strings, the program being executable by the computer to execute functions comprising:

detecting picking of any of the plurality of strings;

detecting a speed of change in a string vibration level at a time point when the state detector detects the state;

providing a sound source with a sound generation instruction of a musical sound of a pitch determined based on the state detected by the state detector and a volume determined based on the detected speed of change;

detecting a vibration pitch of the string of which picking is detected; and correcting the pitch of the musical sound generated by the sound source, based on the detected vibration pitch.

15. A non-transitory storage medium storing a program executable by a computer used in an electronic stringed instrument, the electronic stringed instrument including a plurality of strings stretched above a fingerboard unit provided with a plurality of frets, and a state detector that detects a state between each of the plurality of frets and each of the plurality of strings, the program being executable by the computer to execute functions comprising:

detecting picking of any of the plurality of strings;

detecting a jerk of change in a string vibration level at a time point when the state detector detects the state;

providing a sound source with a sound generation instruction of a musical sound of a pitch determined based on the state detected by the state detector and a volume determined based on the detected jerk of change;

detecting a vibration pitch of the string of which picking is detected; and correcting the pitch of the musical sound generated by the sound source, based on the detected vibration pitch.

* * * * *